US010197954B1

(12) United States Patent
Mizutani

(10) Patent No.: US 10,197,954 B1
(45) Date of Patent: Feb. 5, 2019

(54) IMAGE FORMING APPARATUS AND IMAGE FORMING METHOD INCLUDING A CLEANING SHEET FOR REMOVING ADHESIVE FROM LABEL PAPER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kikuo Mizutani, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/711,037

(22) Filed: Sep. 21, 2017

(51) Int. Cl.

| | |
|---|---|
| ***G03G 15/20*** | (2006.01) |
| ***G03G 15/00*** | (2006.01) |
| ***G03G 15/16*** | (2006.01) |

(52) U.S. Cl.
CPC ..... *G03G 15/2025* (2013.01); *G03G 15/161* (2013.01); *G03G 15/6588* (2013.01); *G03G 15/6591* (2013.01); *G03G 15/6594* (2013.01); *G03G 2215/00308* (2013.01); *G03G 2215/00476* (2013.01); *G03G 2215/00493* (2013.01); *G03G 2215/00523* (2013.01); *G03G 2215/00531* (2013.01)

(58) Field of Classification Search
CPC ..... G03G 15/2025; G03G 15/2075; G03G 15/6588; G03G 15/6591; G03G 15/6594; G03G 2215/00308; G03G 2215/00312; G03G 2215/00476; G03G 2215/00493; G03G 2215/00523; G03G 2215/00531
See application file for complete search history.

(56) References Cited

U.S. PATENT DOCUMENTS

2002/0112300 A1* 8/2002 Muhr-Sweeney ..... B08B 1/00 15/104.002
2016/0098004 A1* 4/2016 Shinagawa ..... G03G 15/2025 399/81

FOREIGN PATENT DOCUMENTS

| | | | |
|---|---|---|---|
| JP | 10-010910 | | 1/1998 |
| JP | 2003189058 A | * | 7/2003 |
| JP | 2007-206547 | | 8/2007 |
| JP | 2016-090813 | | 5/2016 |

* cited by examiner

*Primary Examiner* — Joseph S Wong
(74) *Attorney, Agent, or Firm* — Amin, Turocy & Watson LLP

(57) ABSTRACT

In accordance with an embodiment, an image forming apparatus comprises a fixing section, a sheet housing section, and a sheet passing controller. The fixing section fixes a developer by heating a label paper onto which the developer is transferred. The sheet housing section houses a cleaning sheet from which adhesive leaking out from the label paper and adhering to the fixing section is removed. The sheet passing controller conveys the cleaning sheet from the sheet housing section to the fixing section.

10 Claims, 7 Drawing Sheets

IMAGE FORMING APPARATUS AND IMAGE FORMING METHOD INCLUDING A CLEANING SHEET FOR REMOVING ADHESIVE FROM LABEL PAPER

FIELD

Embodiments described herein relate generally to an image forming apparatus and an image forming method.

BACKGROUND

In recent years, in an image forming apparatus, printing is performed on not only ordinary sheets but also various media such as a label paper, a sheet in which a paper surface is coated, a plastic medium such as an OHP and the like.

However, in the case of the media with an adhesive layer such as the label paper, if heat and pressure are applied to the media, there is a case in which glue of the adhesive layer adheres to an image carrier, a fixing device or a conveyance path. The adhering glue is not sufficiently removed by a cleaner section for removing residual toner on the image carrier. Consequently, a cleaning defect occurs, and problems such as a conveyance failure and an image defect occur in some cases.

DETAILED DESCRIPTION

In accordance with an embodiment, an image forming apparatus comprises a fixing section, a sheet housing section, and a sheet passing controller. The fixing section fixes a developer by heating a label paper onto which the developer is transferred. The sheet housing section houses a cleaning sheet from which adhesive leaking out from the label paper and adhering to the fixing section is removed. The sheet passing controller conveys the cleaning sheet from the sheet housing section to the fixing section.

In the case of printing on a label paper, an image forming apparatus 100 of the present embodiment conveys a cleaning sheet after printing on the label paper. The cleaning sheet is a special paper or a plain paper. A length in a width direction of the cleaning sheet is longer than the label paper. A length in a conveyance direction of the cleaning sheet is longer than that of a perimeter of a roller having the largest diameter (for example, a heat roller 131) of the image forming apparatus 100.

Figure 1:
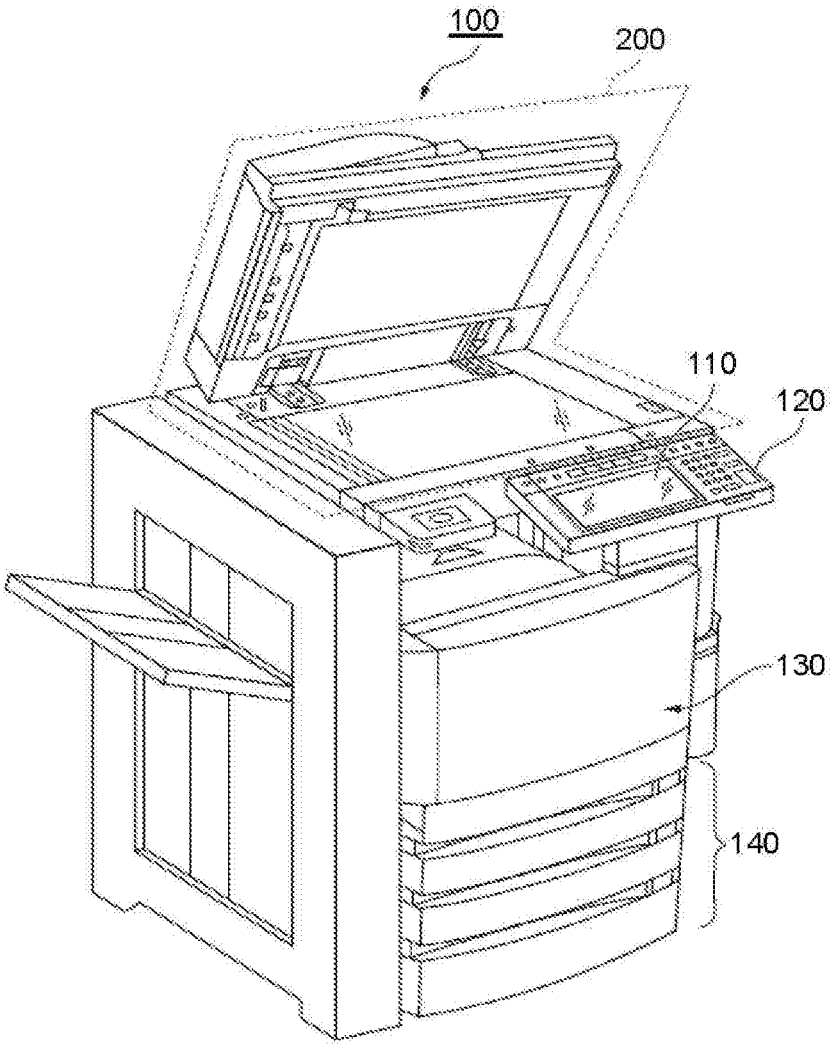
FIG. 1 is an external view of an image forming apparatus.

FIG. 1 is an external view exemplifying the overall constitution of an image forming apparatus 100 according to the embodiment. The image forming apparatus 100 is, for example, a multi-functional peripheral. The image forming apparatus 100 includes a display 110, a control panel 120, a printer section 130, a sheet housing section 140 and an image reading section 200. Furthermore, the printer section 130 of the image forming apparatus 100 is a device for fixing a toner image.

The image forming apparatus 100 forms an image on a sheet using a developer such as a toner. The sheet is, for example, a paper or a label paper. The sheet may be an optional object as long as the image forming apparatus 100 can form an image on a surface thereof.

The display 110 is an image display device such as a liquid crystal display, an organic EL (Electro Luminescence) display and the like. The display 110 displays various information relating to the image forming apparatus 100.

The control panel 120 includes a plurality of buttons. The control panel 120 receives an operation by a user. The control panel 120 outputs a signal in response to an operation executed by the user to a controller of the image forming apparatus 100. Furthermore, the display 110 and the control panel 120 may be constituted as an integrated touch panel.

The printer section 130 forms an image on the sheet based on image information generated by the image reading section 200 or image information received through a communication path. The printer section 130 forms an image through the following processing, for example. An image forming section of the printer section 130 forms an electrostatic latent image on a photoconductive drum 149 based on the image information. The image forming section of the printer section 130 forms a visible image by attaching the developer to the electrostatic latent image. Toner is exemplified as a concrete example of the developer. A transfer section of the printer section 130 transfers the visible image onto the sheet. A fixing section of the printer section 130 fixes the developer that forms the visible image on the sheet by heating and pressurizing the sheet. The sheet on which the image is formed may be a sheet housed in the sheet housing section 140, or a sheet that is manually fed.

The sheet housing section 140 houses the sheet used in the image formation by the printer section 130.

The image reading section 200 reads the image information which is a reading object as intensity of light. The image reading section 200 records the read image information. The recorded image information may be transmitted to another information processing apparatus via a network. The recorded image information may be used to form an image on the sheet by the printer section 130.

Figure 2:
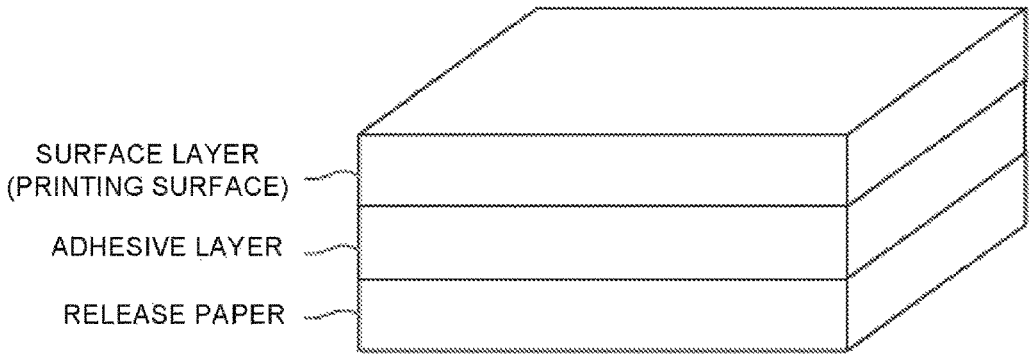
FIG. 2 is a specific example of the a label paper.

FIG. 2 is a diagram illustrating a specific example of the constitution of the label paper. The label paper is constituted by a release paper, an adhesive layer and a surface layer. The label paper is used by peeling off the surface layer and the adhesive layer from the release paper. The adhesive layer is composed of the adhesive. The adhesive layer adheres to a contacting substance after being released from the release paper. The adhesive leaks out from an edge in some cases if pressure is applied to the adhesive layer. For example, the adhesive is constituted by glue. The surface layer is a printing surface of the label paper.

Figure 3:
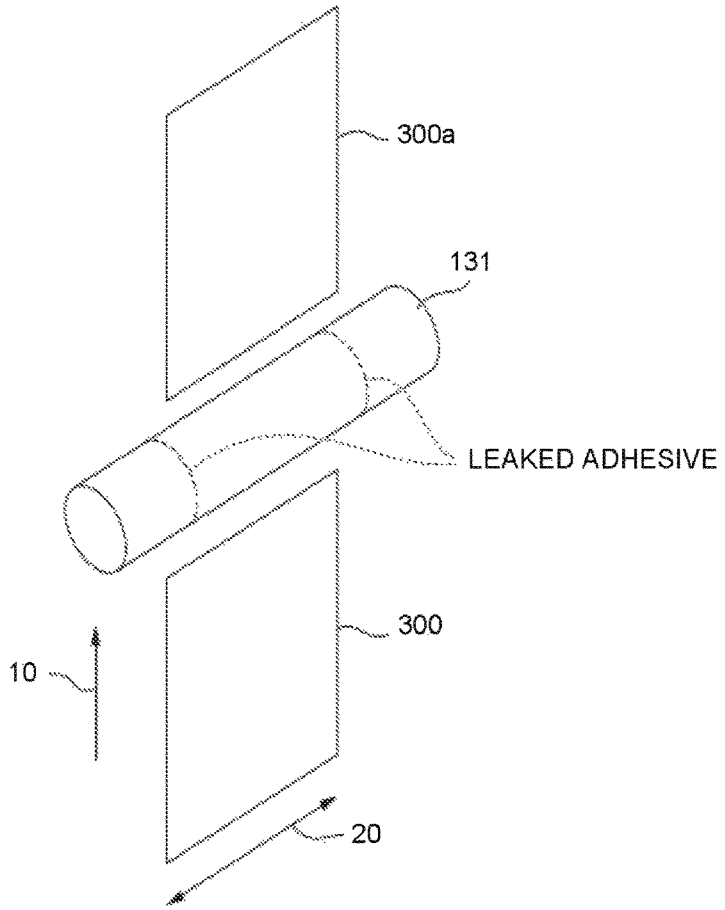
FIG. 3 is a specific example of a state in which adhesive leaks to a heat roller.

FIG. 3 is a diagram illustrating a specific example of a state in which the adhesive leaks to the heat roller 131 of the image forming apparatus 100 according to the embodiment. The heat roller 131 is accommodated in the printer section 130. The heat roller 131 melts the developer attached to the sheet. The surface of the heat roller 131 is coated with Teflon or the like. The adhesive is cleaned by passing a sheet such as a plain paper through the heat roller 131.

The label paper 300 shows a label paper before the sheet passes through the heat roller 131. The label paper 300 is a label paper before the developer is melted and fixed. An arrow 10 indicates the conveyance direction of the label paper 300. The label paper 300 is conveyed along the arrow 10. An arrow 20 indicates the length in the width direction of the label paper 300. A label paper 300*a* shows a label paper after passing through the heat roller 131. The label paper 300*a* shows a label paper after the developer is melted and fixed.

If the label paper 300 passes through the heat roller 131, the adhesive leaks from the label paper 300. The leaked adhesive adheres to a position where the heat roller 131 and an end in the width direction of the label paper 300 contact with each other. A dotted line depicted on the heat roller 131 represents the adhesive attached to the heat roller 131. Since the portion other than the end in the width direction of the label paper 300 is cleaned by the label paper 300, the adhesive hardly adheres to the heat roller 131.

Figure 4:
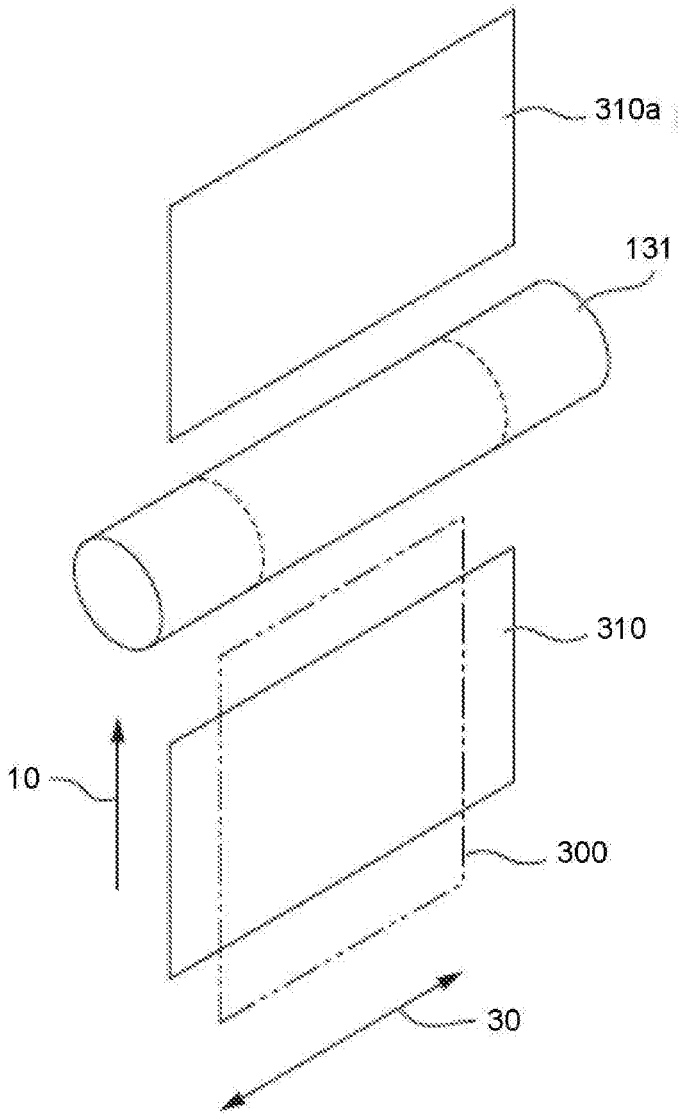
FIG. 4 is a specific example of a state in which a cleaning sheet passes through the heat roller.

FIG. 4 is a diagram illustrating a specific example of a state in which the cleaning sheet passes through the heat roller 131 of the image forming apparatus 100 according to the embodiment. A cleaning sheet 310 shows the cleaning sheet before passing the heat roller 131. The arrow 10 indicates the conveyance direction of the label paper 300. The cleaning sheet 310 is conveyed along the arrow 10. An arrow 30 indicates the length in the width direction of the cleaning sheet 310. As shown in FIG. 4, the length in the width direction of the cleaning sheet 310 is longer than that in the width direction of the label paper 300. The length of the outer circumference of the heat roller 131 is shorter than the length in the conveyance direction of the cleaning sheet 310. Therefore, the cleaning sheet 310 contacts with the adhesive attached to the heat roller 131. The cleaning sheet 310 removes the adhesive contacting with the cleaning sheet 310 from the heat roller 131. The heat roller 131 is cleaned by removing the adhesive. The length in the width direction of the heat roller 131 is shorter than that in the width direction of the cleaning sheet 310. The cleaning sheet 310*a* shows a cleaning sheet after passing through the heat roller 131.

Figure 5:
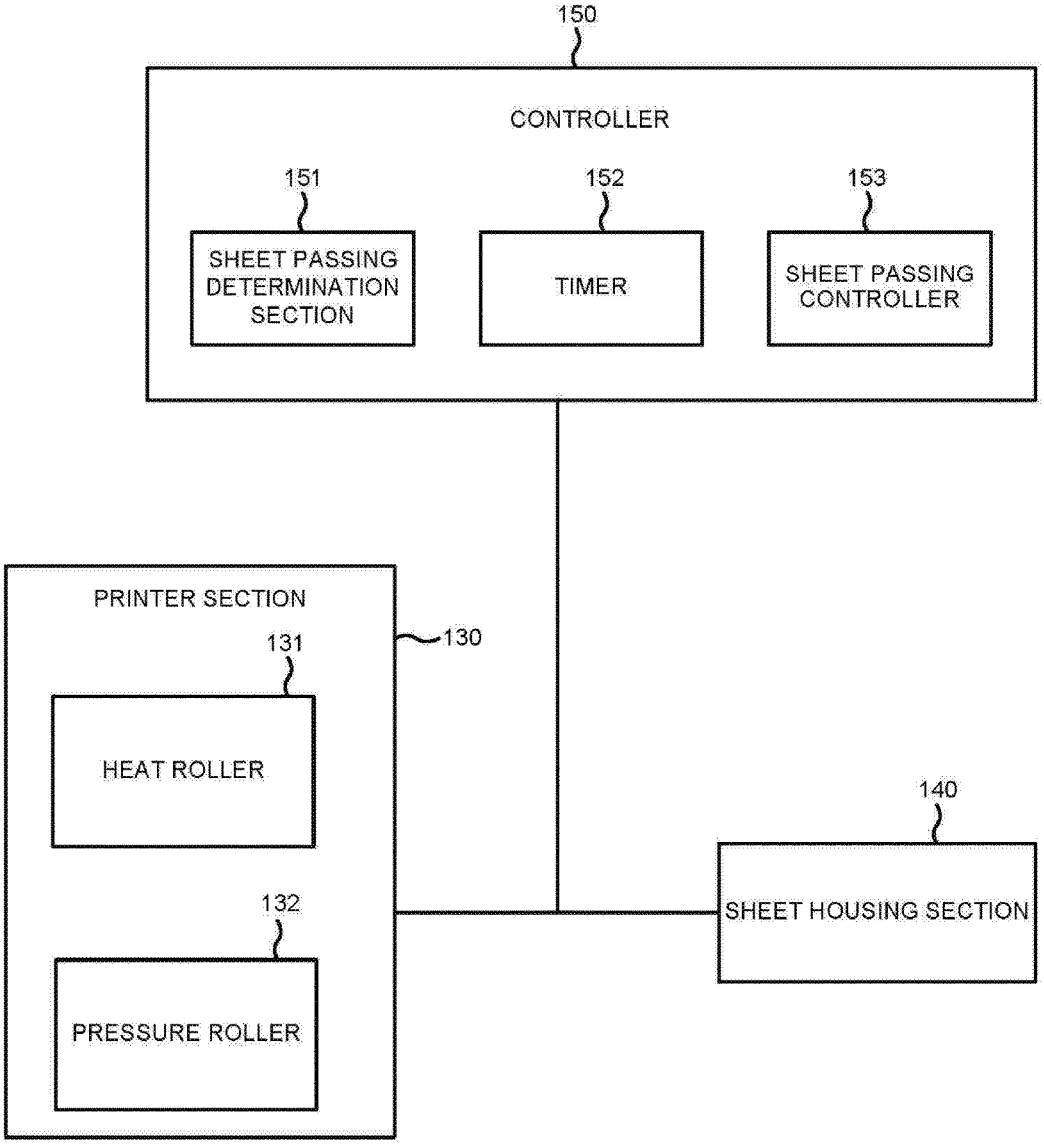
FIG. 5 is a functional block diagram of the image forming apparatus.

FIG. 5 is a functional block diagram illustrating the functional components of the image forming apparatus 100 according to the embodiment. The image forming apparatus 100 includes the printer section 130, the sheet housing section 140 and a controller 150.

The printer section 130 includes the heat roller 131 and a pressure roller 132. The heat roller 131 has a heat generating section therein. The heat roller 131 is heated by the heat generated by the heat generating section. The heated heat roller 131 melts the developer adhering to the passed sheet. The pressure roller 132 fixes the melted developer on the sheet by applying pressure to the passed sheet.

The controller 150 controls the operation of each section of the image forming apparatus 100. The function of the controller 150 is executed by, for example, an apparatus including a CPU (Central Processing Unit) and a RAM (Random Access Memory) for controlling the entire apparatus. The controller 150 functions as a sheet passing determination section 151, a timer 152 and a sheet passing controller 153 by executing an image forming program.

The sheet passing determination section 151 determines whether to pass the cleaning sheet depending on a paper passing state after the label paper is passed. Specifically, the sheet passing determination section 151 determines to pass the cleaning sheet if a next sheet is not passed in a predetermined time after a printing processing in which the label paper is passed is completed. The sheet passing determination section 151 determines not to pass the cleaning sheet if the sheet with a length in the width direction longer than that of the label paper is passed in the predetermined time after the printing processing in which the label paper is passed is completed. The sheet passing determination section 151 determines to pass the cleaning sheet if the sheet with a length in the width direction shorter than that of the label paper is passed in the predetermined time after the printing processing in which the label paper is passed is completed. The predetermined time may be, for example, a time until the adhesive attached to the heat roller 131 is dried. Apart from the above-described determination processing, the sheet passing determination section 151 may determine to pass the cleaning sheet after the printing processing in which the label paper is passed is completed.

The timer 152 measures the time after the label paper is passed. The timer 152 outputs the measured time to the sheet passing determination section 151. The sheet passing determination section 151 determines whether or not the predetermined time elapses according to the time measured by the timer 152.

The sheet passing controller 153 enables the cleaning sheet to pass through the heat roller 131 if the sheet passing determination section 151 determines to pass the cleaning sheet. Specifically, the cleaning sheet passes through the heat roller 131 in either one of the two patterns shown in FIG. 6 or FIG. 7.

Figure 6:
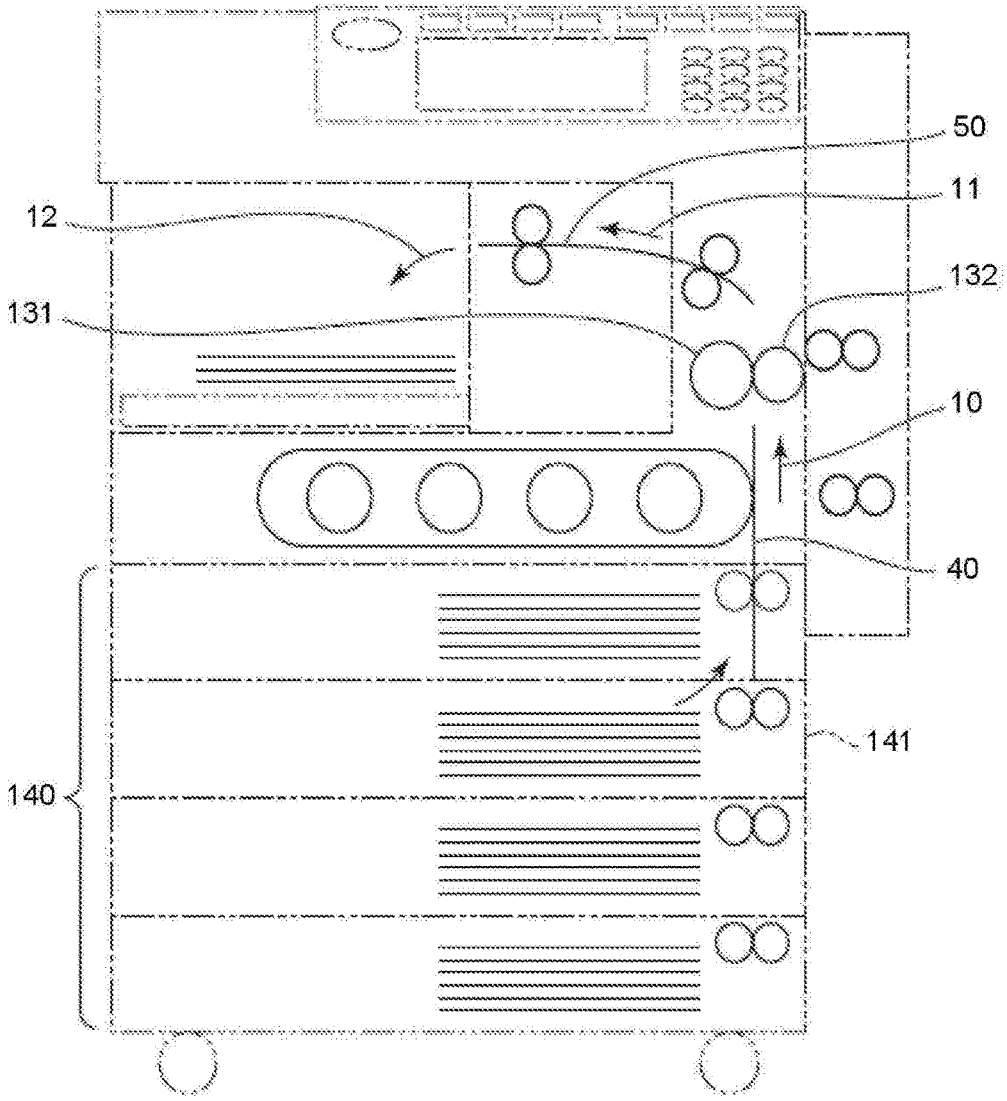
FIG. 6 is a specific example until the cleaning sheet set in a sheet housing section is discharged.

FIG. 6 is a diagram illustrating a specific example until the cleaning sheet set in the sheet housing section 140 is discharged according to the embodiment. According to FIG. 6, the printer section 130 of the embodiment includes a quadruple tandem intermediate system format. The sheet housing section 140 is provided with a cleaning sheet housing section 141. The cleaning sheet housing section 141 accommodates a cleaning sheet. A solid line 40 and a solid line 50 indicate conveyance paths of the cleaning sheet. The cleaning sheet is conveyed between the heat roller 131 and the pressure roller 132. The arrow 10, an arrow 11 and an arrow 12 indicate the conveyance directions of the cleaning sheet.

The cleaning sheet housed in the cleaning sheet housing section 141 is conveyed along the conveyance path shown by the arrow 10. The cleaning sheet removes the adhesive attached to the heat roller 131 at the time of passing through the heat roller 131. The cleaning sheet passing through the heat roller 131 is conveyed and discharged along the arrow 11 and the arrow 12.

Figure 7:
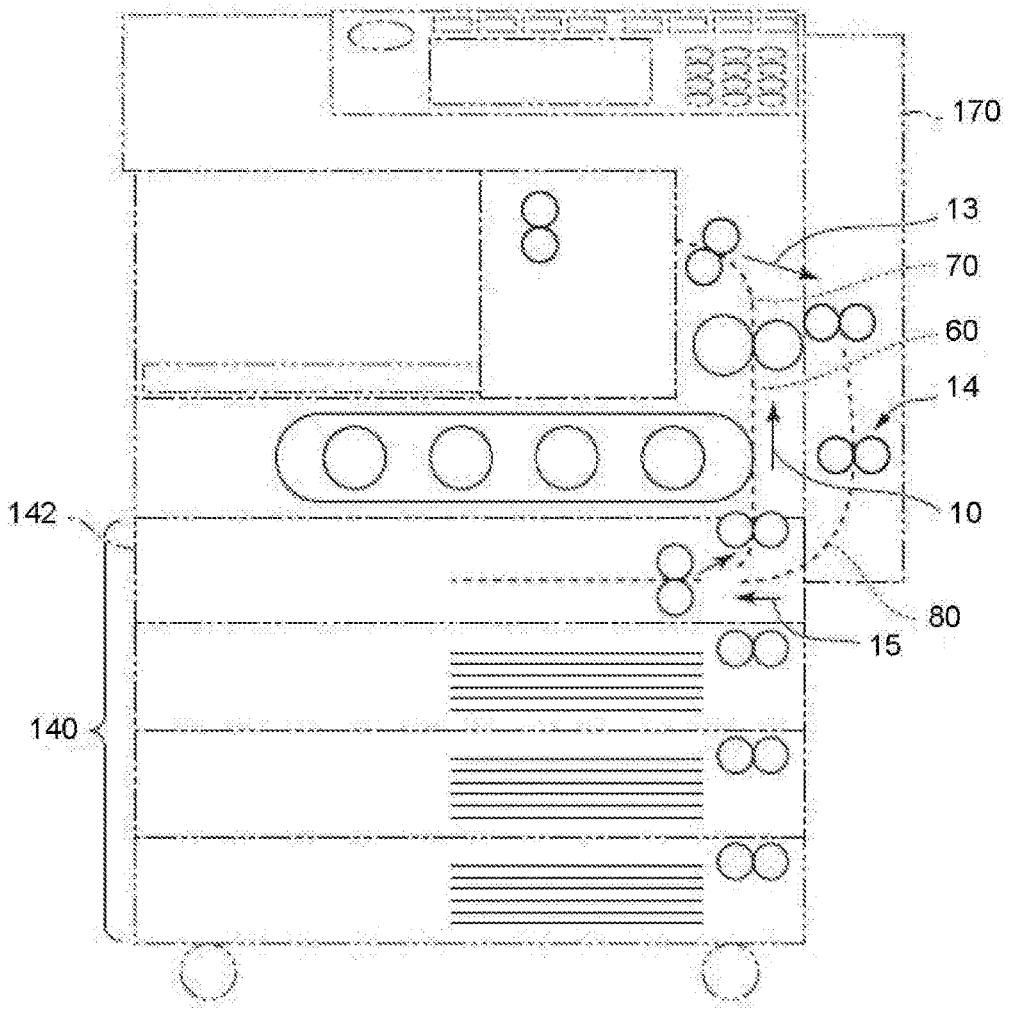
FIG. 7 is a specific example of a processing of circulating the cleaning sheet.

FIG. 7 is a diagram illustrating a specific example of the processing of circulating the cleaning sheet set in the sheet housing section 140 according to the embodiment. The sheet housing section 140 includes a cleaning sheet placement section 142. The cleaning sheet placement section 142 houses the cleaning sheet. An ADU (Auto Duplex Unit) 170 is used for circulating a sheet in the image forming apparatus 100. The ADU 170 is used if a duplex printing is performed in the image forming apparatus 100. The ADU 170 conveys the cleaning sheet along an arrow 14 and an arrow 15 to the cleaning sheet placement section 142. A dotted line 60, a dotted line 70 and a dotted line 80 indicate the conveyance paths of the sheet. The arrow 10, an arrow 13, the arrow 14 and the arrow 15 indicate the conveyance direction of the sheet.

The cleaning sheet housed in the cleaning sheet placement section 142 is conveyed along the conveyance path shown by the arrow 10. The cleaning sheet removes the adhesive attached to the heat roller 131 at the time of passing the heat roller 131. The cleaning sheet passing through the heat roller 131 is conveyed to the ADU 170 along the arrow 13. The cleaning sheet conveyed to the ADU 170 is conveyed along the conveyance path shown by the arrow 14. The cleaning sheet is conveyed along the conveyance path shown by the arrow 15 to be housed in the cleaning sheet placement section 142. The adhesive adhering to the cleaning sheet does not adhere to the heat roller 131 even if the cleaning sheet is reused.

Figure 8:
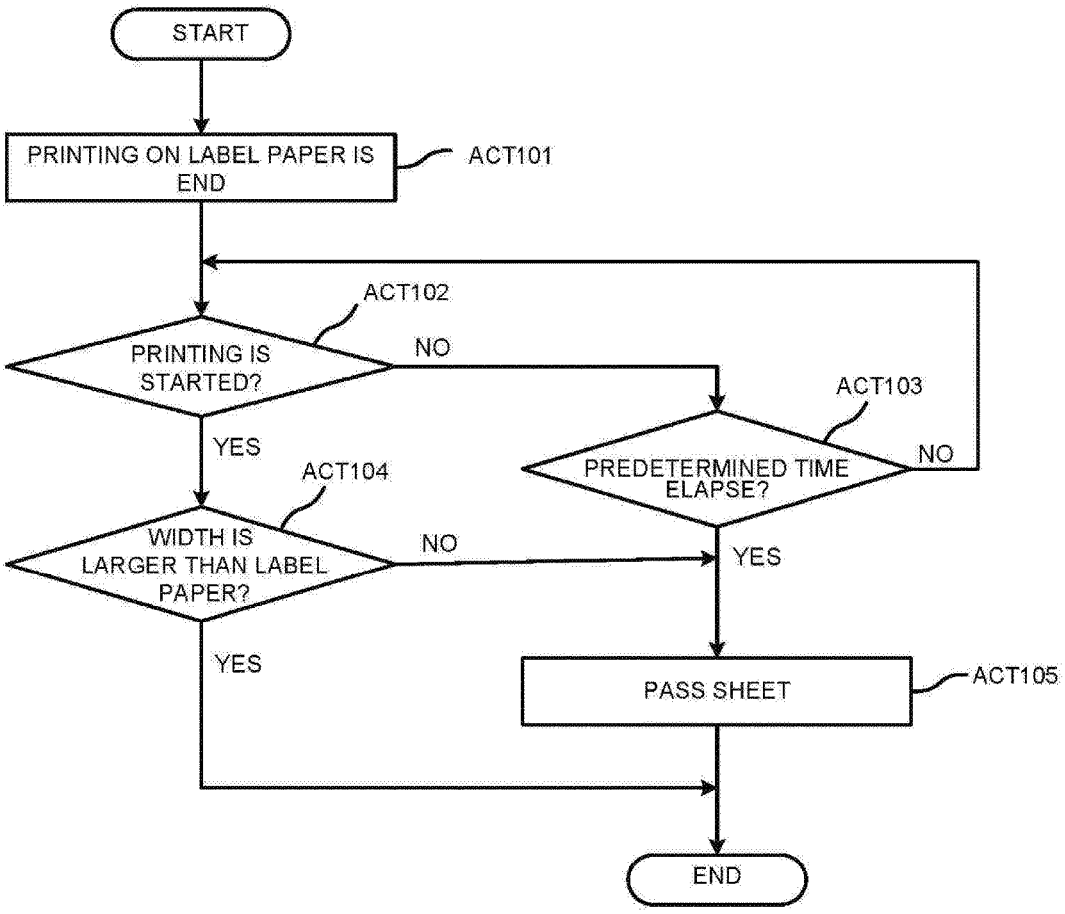
FIG. 8 is a flowchart of a processing of passing the cleaning sheet.

FIG. 8 is a flowchart illustrating the flow of a processing of passing the cleaning sheet according to the embodiment. The printer section 130 of the image forming apparatus 100 ends the printing processing of the label paper (ACT 101). The sheet passing determination section 151 of the image forming apparatus 100 determines whether or not a new printing processing is started (ACT 102). If the new printing processing is not initiated (No in ACT 102), the sheet passing determination section 151 determines whether or not the predetermined time elapses since the printing processing is ended (ACT 103). If the predetermined time does not elapse since the printing processing is ended (No in ACT 103), the flow proceeds to the processing in ACT 102. If the predetermined time elapses after the printing processing is ended (Yes in ACT 103), the flow proceeds to the processing in ACT 105.

If the new printing processing is started (Yes in ACT 102), the sheet passing determination section 151 determines whether or not the sheet having the length in the width direction longer than that of the label paper passes by printing (ACT 104). If the sheet having the length in the width direction longer than that of the label paper is passed (Yes in ACT 104), the processing is terminated. If the sheet having the length in the width direction not longer than that of the label paper is passed (No in ACT 104), the sheet passing controller 153 passes the cleaning sheet.

In the image forming apparatus 100 constituted as described above, even if the adhesive leaking out from the edge in the width direction of the label paper adheres to the heat roller 131, by passing the cleaning sheet, the adhesive attached to the heat roller 131 can be removed. By making the length in the width direction of the cleaning sheet longer than that in the width direction of the label paper, the cleaning sheet can cover the adhesive attached to the heat roller 131. Therefore, the cleaning sheet can remove the adhesive more reliably. By making the length of the conveyance direction of the cleaning sheet longer than that of the circumference of the heat roller 131, the cleaning sheet can contact the entire outer periphery of the heat roller 131. Therefore, the cleaning sheet can remove the adhesive more reliably.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a fixing section configured to fix a developer on a label paper having the developer transferred thereon;

a sheet housing section configured to hold a sheet including a cleaning sheet which removes adhesive leaking out from the label paper and adhering to the fixing section; and a sheet passing controller configured to convey the cleaning sheet from the sheet housing section to the fixing section; wherein the sheet housing section further includes a cleaning sheet placement section to hold the cleaning sheet, and the sheet passing controller to convey the cleaning sheet from the cleaning sheet placement section to the fixing section, and convey the sheet from the fixing section to the sheet housing section via a conveyance path.

2. The image forming apparatus according to claim 1, further comprising a sheet passing determination section configured to determine whether to convey the cleaning sheet to the fixing section, wherein the sheet passing determination section determines that the cleaning sheet is conveyed to the fixing section if a printing processing on the label paper is ended.

3. The image forming apparatus according to claim 1, further comprising a sheet passing determination section configured to determine whether to convey the cleaning sheet to the fixing section, wherein the sheet passing determination section determines to convey the cleaning sheet to the fixing section if a printing processing on the label paper is ended and new printing processing is not started within a predetermined time.

4. The image forming apparatus according to claim 3, wherein the sheet passing determination section determines not to convey the cleaning sheet to the fixing section if a sheet printed by the new printing processing is longer than the label paper in the width direction which is orthogonal to a sheet conveying direction.

5. The image forming apparatus according to claim 3, wherein the sheet passing determination section determines to convey the cleaning sheet to the fixing section if the sheet printed by the new printing processing is shorter than the label paper in the width direction.

6. The image forming apparatus according to claim 1, wherein the sheet passing controller discharges the cleaning sheet conveyed to the fixing section from the image forming apparatus.

7. The image forming apparatus according to claim 1, wherein the fixing section has a length of an outer circumference thereof is shorter than that in a conveyance direction of the cleaning sheet.

8. The image forming apparatus according to claim 1, wherein the fixing section has a length in a width direction thereof is longer than that in the width direction of the cleaning sheet.

9. The image forming apparatus according to claim 1, wherein the cleaning sheet passing through a heat roller is conveyed to an ADU and further conveyed along the conveyance path in the ADU to the cleaning sheet placement section.

10. An image forming method by an image forming apparatus comprising a sheet housing section to hold a cleaning sheet which removes adhesive leaking out from a label paper and adhering to a fixing section, including:

fixing a developer by heating onto the label paper having the transferred developer transferred thereon;

conveying the cleaning sheet from the sheet housing section to the fixing section; and conveying the cleaning sheet from the fixing section to the sheet housing section.

* * * * *